US010809044B2

(12) United States Patent
Perry

(10) Patent No.: US 10,809,044 B2
(45) Date of Patent: Oct. 20, 2020

(54) MECHANICAL BLADE RETENTION SYSTEM FOR ARCHERY BROADHEAD

(71) Applicant: Evolution Outdoors LLC, Goodyear, AZ (US)

(72) Inventor: Dale Wayne Perry, Goodyear, AZ (US)

(73) Assignee: Evolution Outdoors, Goodyear, AZ (US)

( * ) Notice: Subject to any disclaimer, the term of this patent is extended or adjusted under 35 U.S.C. 154(b) by 0 days.

(21) Appl. No.: 16/659,139

(22) Filed: Oct. 21, 2019

(65) Prior Publication Data

US 2020/0124386 A1 Apr. 23, 2020

Related U.S. Application Data

(60) Provisional application No. 62/748,477, filed on Oct. 21, 2018.

(51) Int. Cl.
*F42B 6/08* (2006.01)

(52) U.S. Cl.
CPC ..... *F42B 6/08* (2013.01)

(58) Field of Classification Search
CPC ..... F42B 6/08
USPC ..... 473/583
See application file for complete search history.

(56) References Cited

U.S. PATENT DOCUMENTS 3,036,395 A 5/1962 Nelson
3,138,383 A 6/1964 McKinzie
4,036,499 A 7/1977 Sherwin
4,901,467 A 2/1990 Stolpe
5,102,147 A * 4/1992 Szeluga ..... F42B 6/08 473/584
5,458,341 A * 10/1995 Forrest ..... F42B 6/08 473/583
5,564,713 A * 10/1996 Mizek ..... F42B 6/08 473/583
5,803,844 A * 9/1998 Anderson ..... F42B 6/08 473/583
5,820,498 A * 10/1998 Maleski ..... F42B 6/08 473/584
5,941,784 A 8/1999 Mizek
6,015,357 A * 1/2000 Rizza ..... F42B 6/08 473/583
6,171,206 B1 * 1/2001 Liechty, II ..... F42B 6/08 473/583
6,258,000 B1 * 7/2001 Liechty, II ..... F42B 6/08 473/583
6,287,223 B1 * 9/2001 Liechty, II ..... F42B 6/08 473/583

(Continued)

*Primary Examiner* — Alexander R Niconovich
(74) *Attorney, Agent, or Firm* — Banner & Witcoff, Ltd.

(57) ABSTRACT

Disclosed herein is a mechanical arrow broadhead including a ferrule, wherein the ferrule includes a plurality of slots, a screw pin, a set screw, and a media hole. A first blade, a second blade, and a base. In some aspects, the first and second blades are held in a retracted position throughout an arrow time of flight. In other aspects, the first and second blades are deployed to an open position upon a target impact. The blades pivot from the retracted to the deployed position on an axis of the screw pin, the blades are extended through the plurality of slots, and the set screw may be positioned at a bottom of the ferrule below the screw pin.

19 Claims, 7 Drawing Sheets

(56) References Cited

U.S. PATENT DOCUMENTS 6,287,224 B1 * 9/2001 Liechty, II ..... F42B 6/08 473/583
6,793,596 B1 * 9/2004 Sullivan ..... F42B 6/08 473/583
6,910,979 B2 * 6/2005 Barrie ..... F42B 6/08 473/583
7,226,375 B1 * 6/2007 Sanford ..... F42B 6/08 473/583
7,771,298 B2 * 8/2010 Pulkrabek ..... F42B 6/08 473/583
8,016,704 B1 * 9/2011 Vandewater ..... F42B 6/08 473/583
RE44,144 E * 4/2013 Barrie ..... 473/583
8,449,415 B2 * 5/2013 Grace ..... F42B 6/08 473/583
8,684,869 B1 * 4/2014 Perry ..... F42B 6/08 473/583
8,758,176 B2 * 6/2014 Pedersen ..... F42B 6/08 473/583
8,905,874 B2 * 12/2014 Sullivan ..... F42B 12/34 473/583
9,028,349 B2 * 5/2015 Budris ..... F42B 6/08 473/583
9,194,673 B1 * 11/2015 Lee ..... F42B 12/34
9,372,056 B2 * 6/2016 Sullivan ..... F42B 6/08
9,404,722 B2 * 8/2016 Pedersen ..... F42B 6/08
9,526,234 B2 * 12/2016 Harshberger ..... A01K 81/00
9,857,152 B2 * 1/2018 Franco, Sr. ..... F42B 6/08
9,945,647 B2 * 4/2018 Pugliese ..... F42B 6/08
9,945,648 B2 * 4/2018 Grace ..... F42B 6/08
10,288,392 B2 * 5/2019 Haas ..... F42B 6/08
10,309,754 B2 * 6/2019 Pugliese ..... F42B 12/34
10,415,940 B2 * 9/2019 Sullivan ..... F42B 12/34
2002/0151394 A1 10/2002 Arasmith
2004/0048704 A1 3/2004 Arasmith
2012/0040787 A1 * 2/2012 Ulmer ..... F42B 6/08 473/583
2012/0178560 A1 * 7/2012 Grace ..... F42B 6/08 473/583
2013/0102425 A1 * 4/2013 Mizek ..... F42B 6/08 473/583
2013/0102426 A1 * 4/2013 Mizek ..... F42B 6/08 473/583
2017/0131073 A1 * 5/2017 Buchanan ..... F42B 6/08
2018/0292190 A1 * 10/2018 Buchanan ..... F42B 6/08

* cited by examiner

MECHANICAL BLADE RETENTION SYSTEM FOR ARCHERY BROADHEAD

CROSS REFERENCE TO RELATED APPLICATION

This application claims benefit to U.S. Provisional Application No. 62/748,477 filed on Oct. 21, 2018. All of the above applications are incorporated herein by reference.

FIELD OF THE INVENTION

The present disclosure generally relates to mechanical arrow broadheads that deploy blades upon contact with a target. Mechanical broadheads typically include blades that remain in a stowed and aerodynamic position during the time of flight of an arrow. Upon contact with a target, the blades deploy to an open or extended position.

BACKGROUND

An arrow launched from a bow typically includes a shaft, stabilizers or fins known as fletchings and an arrowhead. Various types of arrowheads exist such as a broadhead used by hunters. A broadhead typically includes two to four sharp cutting-blades to injure or kill a target. Bow hunters typically use two main types of broadheads to include fixed-blade and the mechanical. Fixed-blade broadheads maintain blades in a rigid and unmovable position and a mechanical broadhead deploys its blades upon contact with the target. In most cases, the arrow with the mechanical broadhead flies better because it is more aerodynamic, but has less penetration compared to the fixed-blade broadhead since it uses some of the kinetic energy in the arrow to deploy its blades.

Holding the blades of a mechanical broadhead in the retracted or closed position, and deploying the mechanical blades is a critical component to efficient and effective broadhead design. The retention system that maintains the blades in the retracted position is critical to the mechanical broadhead design. Prior examples of mechanical broadheads typically included additional features such as mechanical shafts and springs to aid in the deployment and function of the blades, see e.g., U.S. Pat. No. 7,226,375, Expandable Arrow Broadhead for Attachment to One End of an Arrow Shaft, and U.S. Patent Publication 2012/0040787, Mechanical Broadhead with Pivoting, Interlocking Blades, both incorporated herein by reference in their entirety for all purposes. In the present disclosure, the system uses a consistent piece of media to hold the mechanical blades in a stored or closed position, yet permits deployment of the blades upon target impact. The type and location of the media is critical as this allows the blades to deploy with the minimum amount of force yet keeping the blades in the closed position without the possibility of accidental deployment. In the closed or retracted position a notch cut in the bottom of each blade aligns and a piece of media is compressed in the notch to create tension on the blades forcing the blades to remain in the closed position. Upon impact of the intended target, the blades push down the media and compress the top edge allowing the blades to deploy.

Many forms of mechanical broadhead blade retention systems have been used using additional components such as rubber bands, clips, gears, springs, etc. Each of these prior mechanisms, however, have increased rates of failure compared to the mechanical broadhead disclosed herein. For example, rubber bands are exposed to the elements and can become brittle or lose their elasticity, springs can oxidize and deform, and other retention systems create single points of failure. Further, existing systems are configured on the sides of the blades or above the blades to generate, i.e., equal with or above the pivot point, requiring more force to deploy the blades. The mechanical broadhead of the current disclosure, however, includes a novel retention system at the bottom of the blades and below the pivot point to provide a more efficient means to deploy the blades.

SUMMARY OF THE INVENTION

This disclosure generally relates to mechanical arrow broadheads that deploy blades upon contact with a target. The streamlined configuration of a broadhead with its blades in the retracted position typically provides a more stabilized arrow flight-path.

In accordance with an exemplary illustrative embodiment, a mechanical arrow broadhead disclosed herein includes a ferrule, wherein the ferrule includes a plurality of slots, screw pin, a set screw and a media hole. A first blade, a second blade, and a base. In some aspects, the first and second blades are held in a retracted position throughout an arrow time of flight. In other aspects, the first and second blades are deployed to an open position upon a target impact. The blades pivot from the retracted to the deployed position on an axis of the screw pin and extended through the plurality of slots, and the set screw may be positioned at a bottom of the ferrule.

In accordance with another aspect, an archery arrow is disclosed herein that includes an arrow shaft and a mechanical broadhead. In some aspects, the mechanical broadhead is configured to detachably engage the arrow shaft and may further include a ferrule with plurality of slots, a screw pin, a set screw, and a media hole. In still other aspects, the screw pin is positioned above the media hole. In other embodiments, the mechanical broadhead may also include a first blade, a second blade, and a base. In some aspects, the first and second blades are held in a retracted position throughout an arrow time of flight. In still other aspects, the first and second blades are configured to engage the plurality of slots and deploy to an open position upon a target impact. In yet other aspects, the blades may pivot from the retracted to the deployed position on an axis of the screw pin and are extended through the plurality of slots. In other aspects, the set screw may be positioned at a bottom of the ferrule below the screw pin.

In some examples, the set screw may be positioned above or below the screw pin, or to the left or right of the screw pin. In other examples, the first and second blades may further include a notch in an end of the blades, in which the notches of each blade align with each other when the first and second blades are in the retracted position. In still other examples, the first and second blades are held in the retracted position by insertion of a media into the media hole. The media is forced into the aligned notches by the set screw, and the media forces the first and second blades to remain in the retracted position by a friction fit from the force of the media. In yet another example, upon impacting the target, the first and second blades extend into the deployed position by forcing the media from the blade notches and permitting the first and second blades to extend into the deployed position. In some examples, the media may be nylon, a polymer blend, wood, clay, a gel, a paste, a soft metal, or a combination thereof.

In some examples, the mechanical arrow broadhead may include a cutting diameter of at least 2 inches when the blades are extended in the deployed position. In some examples the cutting diameter ranges from 1.5 to 3 inches. In other examples, the first and second blades form an angle from about 90 to 120 degrees when the blades are extended in the deployed position. In other examples, at least two thirds of the first and second blades are contained within the ferrule when the blades are in the retracted position.

In some examples, the blades and/or ferrules may be constructed of 7075 aircraft aluminum, 416 hardened stainless steel, or titanium ceramic, steel, carbon, or combinations thereof. In yet other examples, the base may be threaded and configured to removably engage an arrow shaft or an arrow insert. In still other examples, the broadhead may be configured to detachably engage an archery arrow shaft. In other examples, the mechanical arrow broadhead may include an additional fixed-blade. In still other examples, the fixed-blade may be configured perpendicular to the mechanical blades.

In yet another aspect, a mechanical arrow broadhead system is disclosed herein that includes an arrow broadhead configured to detachably engage an arrow shaft or an arrow insert. In certain aspects, the broadhead may include a ferrule with a plurality of slots, a screw pin configured above a media hole, a set screw and a sharpened tip. In other aspects the mechanical arrow broadhead system may also include a first blade, a second blade, and a base. In still other aspects, the first and second blades are held in a retracted position throughout an arrow time of flight, and the first and second blades may be deployed to an open position upon a target impact with a cutting diameter of at least 2 inches. In other aspects, the blades may pivot from the retracted to the deployed position on an axis of the screw pin and are extended through the plurality of slots. In some aspects, the first and second blades may be held in the retracted position by insertion of a media into the media hole. The media is forced by the set screw into the aligned notches of the blades and the media forces the first and second blades to remain in the retracted position by a friction fit. In other aspects, upon impacting the target, the first and second blades extend into the deployed position by forcing the media from the blade notches and permitting the first and second blades to extend into the deployed position.

In some examples, the blades may have a thickness from 0.020 inches to 0.085 inches. In other examples, the blades may have a length of ¾ inches to 1.5 inches. In another example, the ferrule may have an overall length of at least 1.25 inches and a diameter of at least 0.225 inches. In other examples, the ferrule may also include a sharpened tip. In another example, weight of the broadhead may be between 115 and 125 grains.

The advantages and features of novelty characterizing various aspects of the invention are pointed out with particularity in the appended claims. To gain an improved understanding of the advantages and features of novelty, however, reference may be made to the following descriptive matter and accompanying drawings that describe and illustrate various embodiments and concepts related to the aspects of the invention.

BRIEF DESCRIPTION OF THE DRAWINGS

The foregoing Summary, as well as the following Detailed Description, will be better understood when considered in conjunction with the accompanying drawings in which like reference numerals refer to the same or similar elements in all of the various views in which that reference number appears.

Further, it is to be understood that the drawings may represent the scale of different components of one single embodiment; however, the disclosed embodiments are not limited to that particular scale.

DETAILED DESCRIPTION

As disclosed and described herein, a mechanical broadhead that employs the use of a media placed at the bottom of the broadhead blades and within the ferrule, to prevent exposure to the elements, requires less overall force to open or deploy the blades upon target impact. Thus, more energy is transmitted to the target resulting in improved target penetration and reliable and consistent blade deployment. Accordingly, such a mechanical broadhead retention and deployment system provides a bow hunter with a superbly reliable system with significantly decreased failures compared to existing mechanical broadheads.

Figure 1:
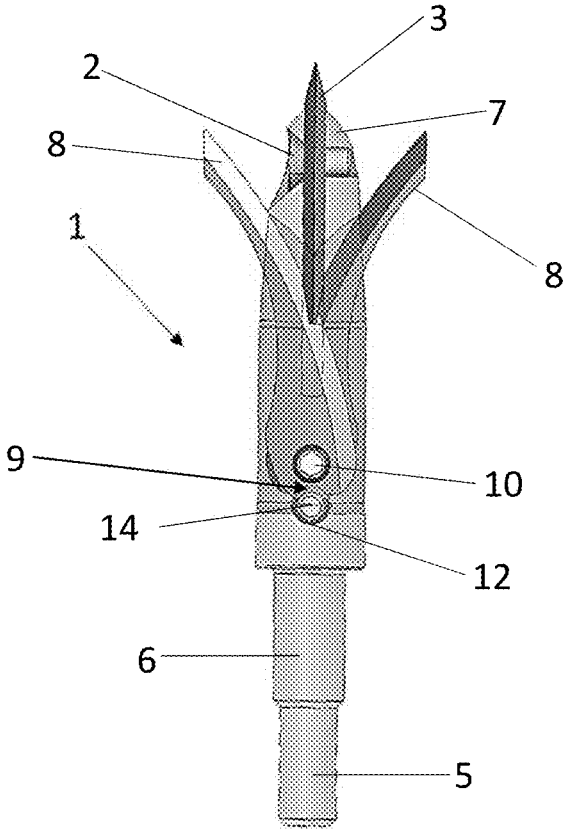
FIG. 1 illustrates a perspective view of a mechanical broadhead with the blades in a closed/stowed or retracted position as disclosed herein.

As shown in FIG. 1, the mechanical arrow broadhead 1 includes a ferrule 7, at least two blades 8, blade notches 9, a cylindrical screw pin 10 that is filled with a media 14 in lower hole 12. The broadhead may also include set screw 11 that may be configured above or below the screw pin 10. The broadhead may also include rear end 6 and threads 5. Rear end 6 of ferrule 7 is adapted to be attached to an arrow shaft by means of threads 5 formed in the rear end 6 of ferrule 7. Ferrule 7 may be formed of any suitable material such as steel, titanium, composite, plastic, alloy, carbon fiber, etc. In some embodiments, as shown in FIG. 1, the broadhead may include blade 3 attached to the ferrule by grommet 2. Blade 3 may be configured in an orientation that is perpendicular to the blades 8. In some examples, the fixed-blade 3 may include at least two integrated blades in a single piece. In some examples, blade 3 may be fixed or removable from ferrule 7 depending upon the user's preference. The mechanical broadhead may include at least two blades 8 that can deploy from a closed to an open/deployed position. Blades 8 may include a tip with sides that are parallel to the blade shaft when the blades 8 are in the closed or retracted position. At the opposite end of the blade 8 tip, the blades may include a notch 9 that align when each of the blades are in the retracted position. Notch 9 is configured to receive a media 14 that is forced into the lower media hole 12 by the set screw 11 and forced into the notches 9 to form a friction fit that retains the blades in a closed or retracted position. The media may be any suitable material such as nylon or polymer or combinations thereof.

Figure 2:
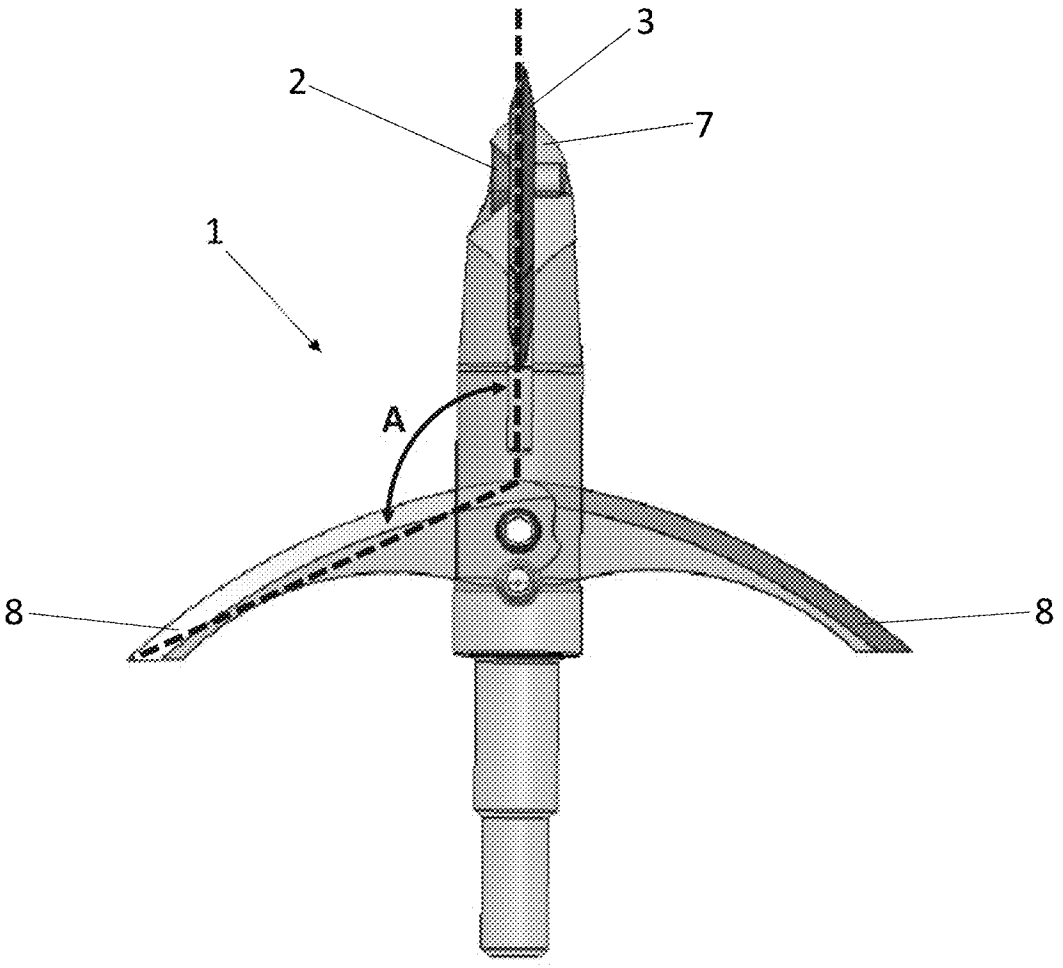
FIG. 2 illustrates a cross-section view of the mechanical broadhead of FIG. 1 with the blades in an open or deployed position as disclosed herein. The media used to hold the blades in the retracted or stowed position in FIG. 1 has been displaced by the blades in the deployed or extended position as shown in FIG. 2 as also disclosed herein.
Figure 3:
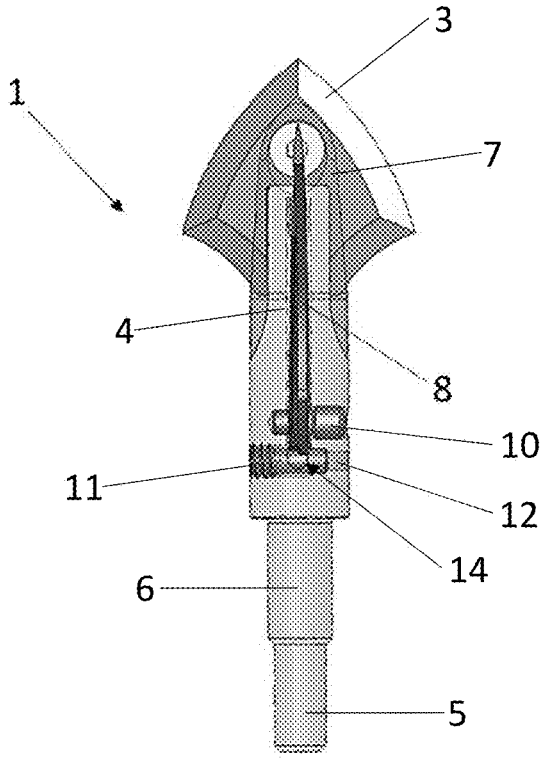
FIG. 3 is a side perspective view of the mechanical broadhead of FIG. 1 with the blades in the closed or retracted position with the set screw pushing the media into the holding/stowed position in the lower media hole as disclosed herein.
Figure 4:
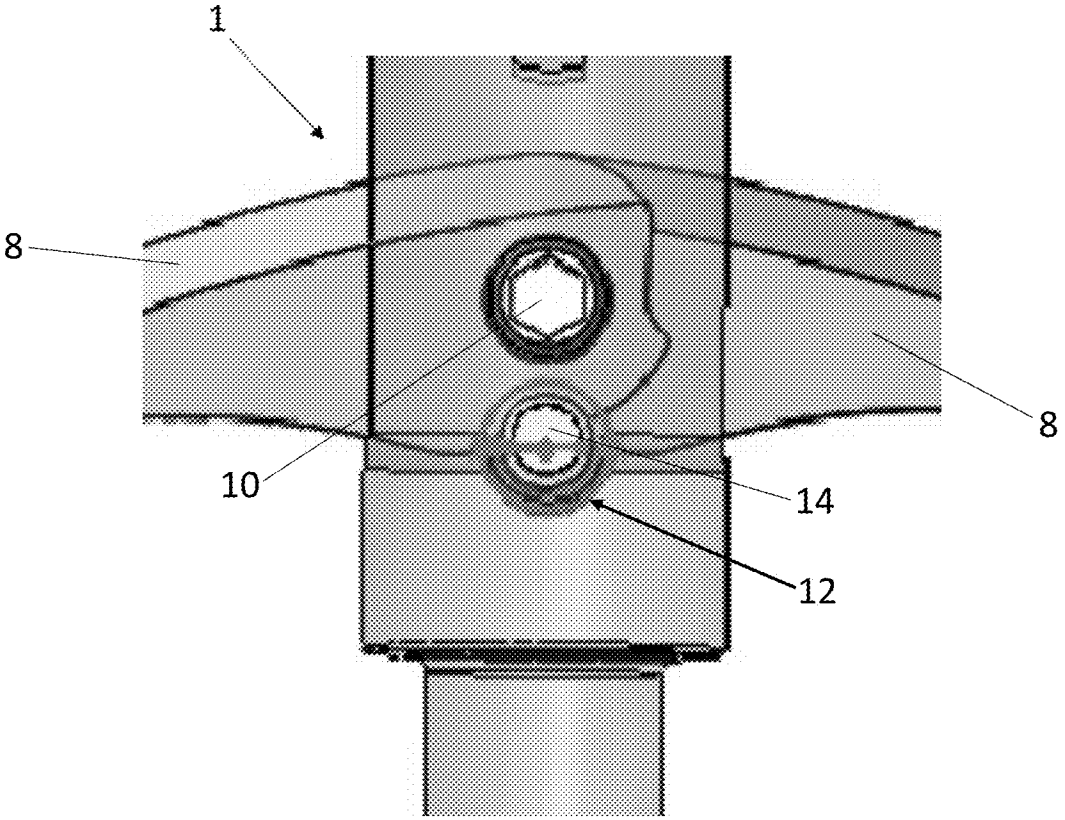
FIG. 4 is an expanded view of the mechanical broadhead of FIG. 2 as disclosed herein.

Upon striking a target, the blade retention system of the mechanical broadhead is deployed to an open position. The blades 8 are forced opposite the vector of the arrow. The force on the blades 8 deploy the blades into an open or extended position. As shown in FIG. 2, the blades 8 pivot from the retracted position to the open/deployed position by rotating around the screw pin 10 axis of the broadhead ferrule 7. The force of the impact on blades 8 forces the media 14 out of the notches 9 and allowing the blades 8 to open. The friction fit of the media 14 in the notches 9 and the set screw 11 assist in holding the blades 8 in the retracted position. By positioning the notches 9 at the bottom of the blade 8 the moment needed to force the blades down is greatly reduced compared to a conventional mechanical broadhead employing an "over the top" blade deployment system. The mechanical broadhead system disclosed herein results in deployment of the blades 8 using less energy and, as a result, increased overall penetration of the target.

As shown in FIG. 2, the angle of the blades 8 in the deployed or open position may form an angle from about 90 to 120 degrees when the blades are extended in the deployed position as measured from the longitudinal axis of the ferrule 7 and arrow shaft to the tip of the blade 8 indicated as angle A. In some examples, the angle of the blades 8 may form a 90 degree angle as measured from the longitudinal axis of the ferrule 7 and arrow shaft to the tip of the blade 8. In other examples, the angle of the blades 8 may form a 30, 35, 40, 45, 50, 55, 60, 65, 70, 75, 80, 85, 90, 95, 100, 105, 110, 115, 120, 125, 130, 135, 140, 145, 150, 155, 160, 165, 170, 175, or 180 degree angle as measured from the longitudinal axis of the ferrule and arrow shaft.

Figure 5:
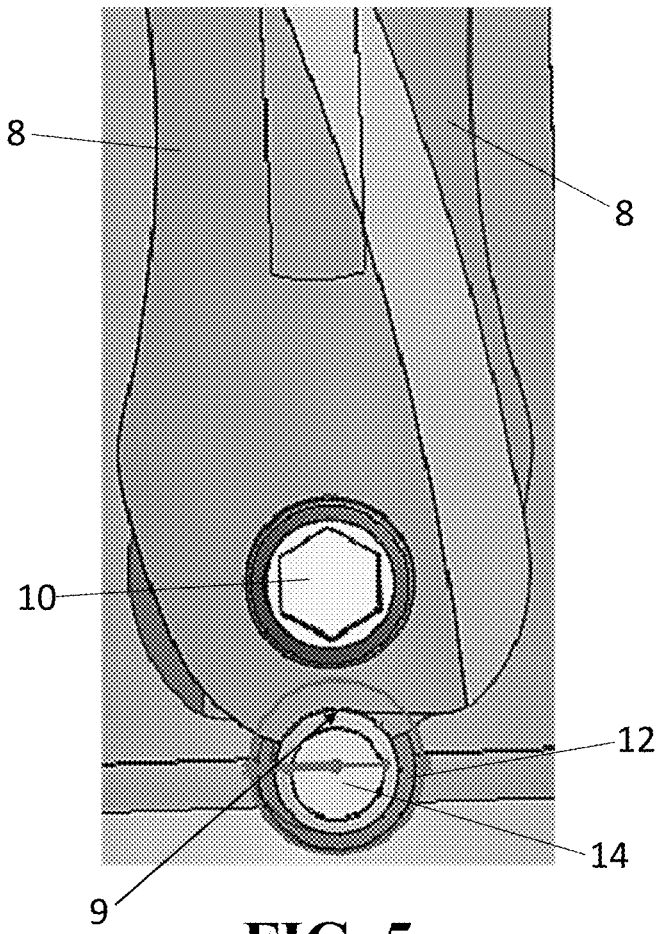
FIG. 5 is an expanded view of the mechanical broadhead of FIG. 3 illustrating the notch in bottom of the blades and providing media compression to hold blades in the retracted or closed position.
Figure 6:
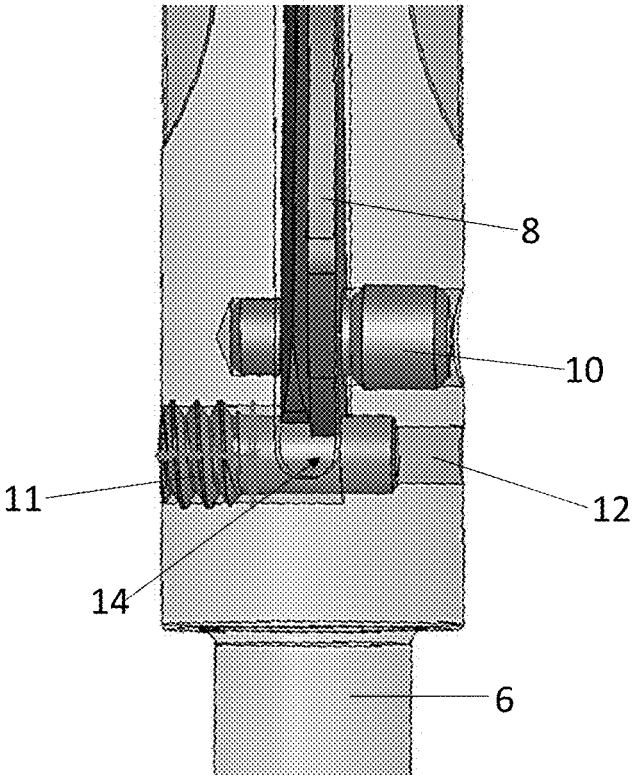
FIG. 6 is an expanded view of the mechanical broadhead of FIG. 3 illustrating the media forced in position by the set screw and providing the compression force to hold blades in the retracted or closed position.

Upon impact the blades 8 work together to force the media 14 out of the way of the notches 9 based on leverage from the exposed tips of the blades 8 and forcing the blades 8 rearward. Referring to FIGS. 1 and 5, the blades 8 are retained freely in the slots 4 on each side of the ferrule body 7 and rotate about an axis provided by screw by a pivot screw 10. As shown in FIG. 5, when the blades 8 are rotated to the stowed or closed position, the notches 9 in the bottom of the blades 8 line up with each other. The blades 8 are held in place by friction fit when media 14 is forced into the blade notches 9 via the lower hole 12. As shown in the expanded view of FIG. 6, the archer forces the media 14 into the lower hole 12 of the ferrule 7 and the media 14 pressed into position by the set screw 11 as to hold the blades 8 securely in the closed position and within the slots 4.

Figure 7:
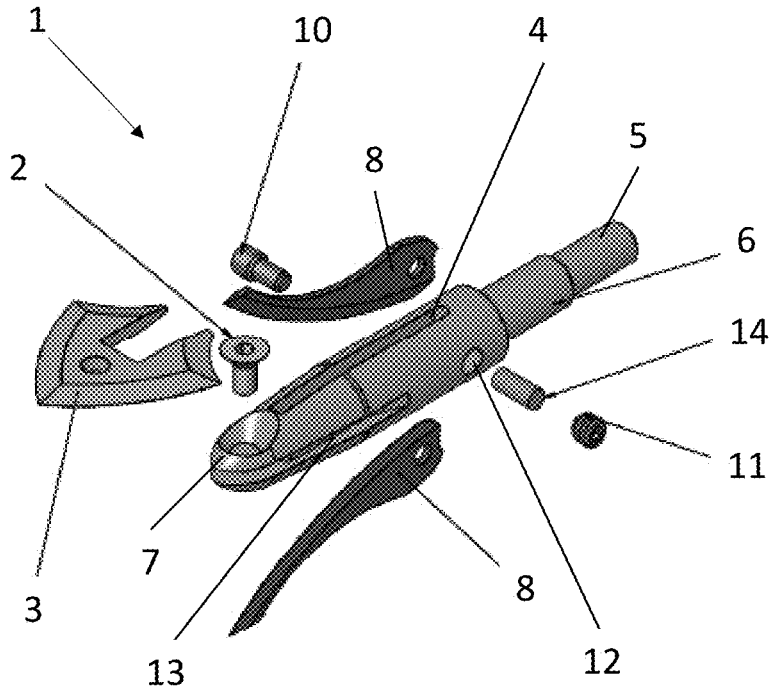
FIG. 7 is an exploded view of the mechanical broadhead of FIG. 1 as disclosed herein.

As shown in FIG. 7, in certain embodiments, the mechanical broadhead 1 disclosed herein may include grommet 2 that secures an optional fixed blade 3 that may be oriented perpendicular to blades 8 and secured partly within upper slot 13. The blades 8 may be contained within slots 4 in the closed position. In alternative embodiments, the blades 8 may also be set in the open or deployed position depending upon the archer's needs. Ferrule 7 may also include lower media hole 12 that may include set screw 11 and media 14 to hold blades 8 in the retracted position. Blades 8 may rotate about the axis of screw pin 10. Rear end 6 may include a lower threaded portion 5 and may be adapted to attach to an arrow shaft. In alternative embodiments, the rear end 6 may or may not include threads 5 and may be attached to an arrow or cross-bow bolt by other means known to one of skill in the art, such as an adhesive, friction fit, screw or bolt and nut, etc.

Variations and modifications of the foregoing are within the scope of the present invention. For example, one of skill in the art will understand that multiples of the described components may be used in stores and in various configurations. The present invention is therefore not to be limited to a single system, nor the upright pusher configuration, depicted in the Figures, as the system is simply illustrative of the features, teachings and principles of the invention. It should further be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. This disclosure is described to cover any and all modifications and forms which may come within the language and scope of the appended claims.

What is claimed is:

1. A mechanical arrow broadhead comprising:

a ferrule, wherein the ferrule includes a plurality of slots, a screw pin, a threaded set screw, and a media hole;

a first blade;

a second blade; and a base, wherein the first and second blades are configured to be held in a retracted position throughout an arrow time of flight, wherein the first and second blades are configured to deploy to an open position upon a target impact, wherein the target impact exerts a force on a cutting edge of the first and second blades forcing the blades into the open position, wherein the blades are configured to pivot from the retracted to the deployed position on an axis of the screw pin and extended through the plurality of slots, wherein the media hole is positioned perpendicular to a longitudinal axis of the ferrule, wherein the threaded set screw removably engages the media hole, wherein the threaded set screw is configured to position a media within the media hold, and wherein the screw pin is positioned at a bottom of the ferrule and above the media hole.

2. The mechanical arrow broadhead of claim 1, wherein the first and second blades further include a notch in an end of the blades, and wherein the notches align with each other when the first and second blades are in the retracted position.

3. The mechanical arrow broadhead of claim 2, wherein the first and second blades are held in the retracted position by insertion of the media into the media hole, and wherein the media is forced into the aligned notches by the threaded set screw, and wherein the media forces the first and second blades to remain in the retracted position by a friction fit.

4. The mechanical arrow broadhead of claim 3, wherein upon impacting the target, the first and second blades extend into the deployed position by forcing the media from the blade notches and permitting the first and second blades to extend into the deployed position.

5. The mechanical arrow broadhead of claim 3, wherein the media is a nylon, a polymer blend or combination thereof.

6. The mechanical arrow broadhead of claim 1, wherein a cutting diameter is at least 2 inches when the blades are extended in the deployed position.

7. The mechanical arrow broadhead of claim 1, wherein the first and second blades form an angle from about 90 to 120 degrees when the blades are extended in the deployed position.

8. The mechanical arrow broadhead of claim 1, wherein at least two thirds of the first and second blades are contained within the ferrule when the blades are in the retracted position.

9. The mechanical arrow broadhead of claim 1, wherein the ferrule is aluminum, carbon, steel, or titanium.

10. The mechanical arrow broadhead of claim 1, wherein the base is threaded and configured to removably engage an arrow shaft or an arrow insert.

11. The mechanical arrow broadhead of claim 1, wherein the broadhead is configured to detachably engage an archery arrow shaft.

12. An archery arrow comprising
an arrow shaft; and
a mechanical broadhead,
wherein the mechanical broadhead is configured to detachably engage the arrow shaft and further comprises:
a ferrule, wherein the ferrule further includes a plurality of slots, a screw pin, a threaded set screw, and a media hole,
wherein the threaded set screw is configured to position a media within the media hole,
wherein the screw pin is positioned above the media hole, and
wherein the media hole is positioned perpendicular to a longitudinal axis of the ferrule;
a first blade;
a second blade; and
a base,
wherein the first and second blades further include a notch in an end of the blades,
wherein the notches align with each other when the first and second blades are in the retracted position,
wherein the first and second blades are configured to engage the plurality of slots and deploy to an open position upon a target impact,
wherein the target impact exerts a force on a cutting edge of the first and second blades forcing the blades into the opening position,
wherein the blades pivot from the retracted to the deployed position on an axis of the screw pin and extended through the plurality of slots, and
wherein the screw pin is positioned above the media hole.

13. The mechanical arrow broadhead of claim 12, wherein the blades have a thickness from 0.020 inches to 0.085 inches.

14. The mechanical arrow broadhead of claim 12, wherein the ferrule has a length of at least 1.25 inches and a diameter of at least 0.220 inches.

15. The mechanical arrow broadhead of claim 12, wherein the first and second blades are held in the retracted position by insertion of the media into the media hole, wherein the media is forced into the aligned notches by the threaded set screw, and wherein the media forces the first and second blades to remain in the retracted position by a friction fit, and wherein upon impacting the target, the first and second blades extend into the deployed position by forcing the media from the blade notches and permitting the first and second blades to extend into the deployed position.

16. The mechanical arrow broadhead of claim 15, wherein the media is a clay, a gel, a paste, a nylon, a polymer, a polymer blend, a wood, or combination thereof.

17. The mechanical arrow broadhead of claim 12, wherein the ferrule further includes a sharpened tip or a fixed blade.

18. The mechanical arrow broadhead of claim 12, wherein weight of the broadhead is between 115 and 125 grains.

19. The mechanical arrow broadhead system comprising
an arrow broadhead configured to detachably engage an arrow shaft or an arrow insert wherein the broadhead further comprises
a ferrule, wherein the ferrule further includes a plurality of slots, a screw pin configured above a media hole wherein the media hole is positioned perpendicular to a longitudinal axis of the ferrule and configured to engage a threaded set screw, and a sharpened tip;
a first blade;
a second blade; and
a base,
wherein the first and second blades further include a notch in an end of the blades,
wherein the notches align with each other when the first and second blades are in a retracted position,
wherein the first and second blades are held in the retracted position by insertion of a media into the media hole,
wherein the media is forced into the aligned notches by the threaded set screw;
wherein the media forces the first and second blades to remain in the retracted position by a friction fit,
wherein the first and second blades are configured to be held in the retracted position throughout an arrow time of flight,
wherein the first and second blades are configured to deploy to an open position upon a target impact with a cutting diameter of at least 2 inches,
wherein the blades pivot from the retracted to the deployed position on an axis of the screw pin and extended through the plurality of slots,
wherein the target impact exerts a force on a cutting edge of the first and second blades forcing the first and second blades into the open position, and
wherein upon impacting the target, the first and second blades are configured to extend into the deployed position by forcing the media from the blade notches and permitting the first and second blades to extend into the deployed position.

* * * * *